US005367786A

United States Patent [19]

Jennings

[11] Patent Number: 5,367,786

[45] Date of Patent: Nov. 29, 1994

[54] METHOD AND APPARATUS FOR MONITORING THE PROCESSING OF A MATERIAL

[76] Inventor: Thomas A. Jennings, 303 Llandrillo Rd., Bala Cynwyd, Pa. 19004

[21] Appl. No.: 610,242

[22] Filed: Nov. 6, 1990

[51] Int. Cl.[5] ..... F26B 3/34

[52] U.S. Cl. ..... 34/245; 34/269; 374/129

[58] Field of Search ..... 34/1 A, 1 E, 1 K, 1 R, 34/1 P, 1 W; 73/19.01; 374/129, 33, 29, 30

[56] References Cited

U.S. PATENT DOCUMENTS 2,360,108 10/1944 Christie ..... 34/1 K
2,427,786 9/1947 Hoyler ..... 34/1 K

FOREIGN PATENT DOCUMENTS 1068740 9/1981 U.S.S.R. ..... 374/129

OTHER PUBLICATIONS

Thermal Analysis, DuPont, Jun. 1963.

*Primary Examiner*—Henry A. Bennet
*Attorney, Agent, or Firm*—William H. Murray

[57] ABSTRACT

A method and apparatus are provided for determining a process parameter of a material in a processing system having two containers. The material being monitored is disposed in one container and a single thermal energy control device is applied to both containers. The heat flux of each container is determined while the single thermal control device is applied to both containers. The process parameter is determined in accordance with the determined heat flux. The thermal energy control device may be a single heating surface for warming the two containers, or a cooling device such as a refrigerator. The process parameter may be the drying rate of the material and the drying rate can be determined during the processing of the material. The drying rate and the percent of drying can be displayed and the thermal energy level of the containers can be controlled according to the determined drying rate. A calibration procedure for calibrating the apparatus is also provided.

51 Claims, 1 Drawing Sheet

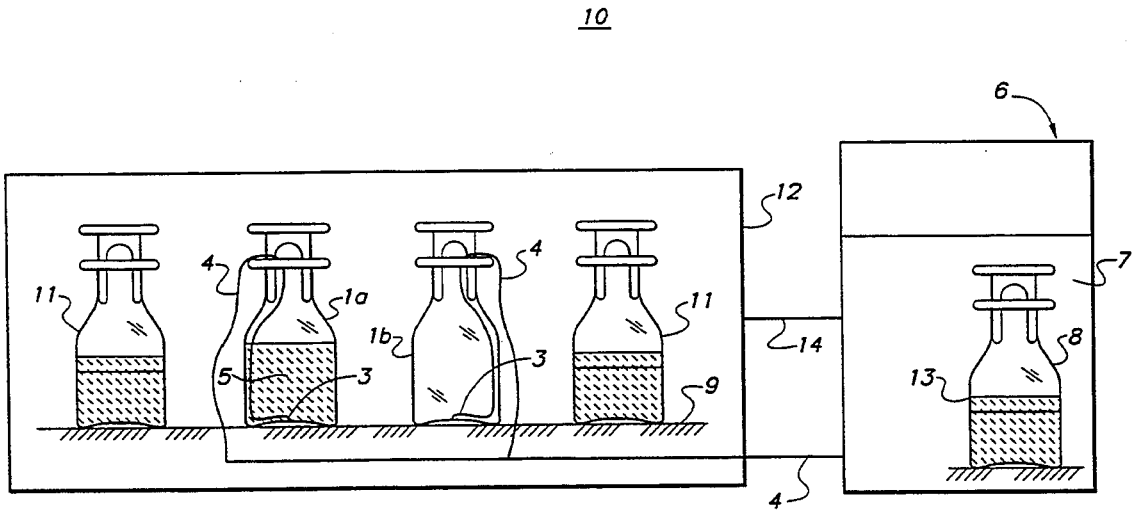

METHOD AND APPARATUS FOR MONITORING THE PROCESSING OF A MATERIAL

BACKGROUND OF THE INVENTION

1. Field Of The Invention

This invention relates to measuring process parameters, and in particular, to measuring process parameters related to heat flux.

2. Background Art

Drying is often used to achieve stability of a material. The drying process may be as simple as the direct evaporation of water from a system or it may be a more complex process such as the lyophilization process. The lyophilization process involves freezing of the material, sublimation of the ice crystals, and desorption of the remaining water vapor.

Regardless of the type of drying process, there is a need to know when the material has been sufficiently dried. If insufficient water is removed from the system, there may be a loss in product or its stability. Likewise, the material may be damaged if the product is overdried. Furthermore, many other parameters related to various methods of processing materials must be reliably measured in order for a material to be processed properly.

A number of methods are known in the prior art for monitoring various parameters involved in the drying process and other types of processes. The simplest method of monitoring a process is to measure the temperature of the material being processed. A change in temperature indicates the completion of a particular phase of the process. Other techniques are known for monitoring both the composition of the gas released during a process such as a drying process and the shelf temperature during the process. The change in the partial pressure of water vapor is also used as an indication of the completion of a drying process. Still other known prior art methods for monitoring the processing of materials such as the drying of the material involve measurement of an electrical property of the material. For example, the resistance of the material may be measured.

The use of these methods, either separately or in combination, provides at best a qualitative assessment of the process. They do not take into account variations such as changes in the quantity of solvent present in the material during the processing. For example, the quantity of water in a material varies as it is dried.

It is also known to use differential scanning calorimetry as an analytical tool. In this method, two containers are placed on separate heating surfaces to measure the heat into a sample container and the heat into a reference container when the two containers are placed on the separate heating surfaces of the calorimeter. These differential scanning calorimetry systems are complex because of the problems raised by the use of the two separate heating surfaces. Further complicating the use of these calorimetry systems is the practical consideration that no two containers are exactly alike in their thermal properties. Thus, the two separate heating surfaces for heating the reference container and the sample container of the differential scanning calorimetry system must be run at different temperatures to compensate for the different thermal properties of the containers. This problem made calibrating differential scanning calorimetry systems very complex.

A further drawbac
scanning calorimetry techniqu
to determine the drying rate of a m
monitored process. Differential scanni
can be used to determine parameters of a m
to processing of the material. Additionally
terminations of the parameters of materials
after processing of the material is complet
the drying rate can not be determined fro

SUMMARY OF THE INVENTI

The present invention provides a method
tus for quantitatively determining process p
a material being processed during a proce
drying process. The drying of this process
tute the removal of water from a materia
limited to water. It is understood that this
also applicable to materials containing
solvent systems. The apparatus and method
ent invention determine the process param
to the material being processed, during th
of the material. These determinations are m
ing to the difference between the heat flux
rial in a sample container and the heat flux
reference container. Furthermore, these de
are made while a single thermal energy co
is applied both to the reference container
sample container.

Using this method, the parameter bein
may, for example, be the rate of drying
process. As a result of such a drying proc
flux to the sample container containing
material is greater than that of the emp
container. The difference in heat flux betw
ple and reference containers when drying
when it does not occur is used to determine
the rate of drying of the material.

The method of the present invention for
the parameters of a material being processe
dent of the type of sensors used to control
Determinations of the rate of drying of
during the process permit control of the v
process parameters. For example, the pre
drying chamber and the thermal energy ap
two containers, as well as the rate of dryin
be controlled based upon the rate of dryin
drying process is still underway. A metho
ing the apparatus of the present invention
vided.

BRIEF DESCRIPTION OF THE DR

The drawing shows the heat flux detecti
the present invention including a sample c
a reference container on a single heating s
computer display system.

DESCRIPTION OF THE PREFE EMBODIMENT

Referring now to the drawing, there is sh
matic diagram of heat flux detection syste
present invention as well as computer syste
forming the processing functions of the m
present invention. Heat flux detection sy
cludes heat flux detection containers 1*a,b*
single heating surface 9 or single heating s
heat flux detection container 1*a,b* is form
stantially the same composition, dimensio
as the other heat flux detection container aluminum foil, on or around heat flux detection container 1b or reference container 1b. This limits the amount of thermal energy transmitted through the outside walls of heat flux detection container 1b. When thermal energy transmission through the outside walls is limited, the temperature of heat flux detection container 1b is influenced less by any radiation of nearby heat flux detection container 1a or further containers 11. This prevents heat flux detection container 1b or reference container 1b from losing a significant amount of energy to sample container 1a or further containers 11 and causes reference container 1b to behave like an empty container.

The heat flux q(o) to unfilled heat flux detection container 1b or reference container 1b within heat flux detection system 10 is defined as:

$$q(o)=q(1)-q(r,1) \quad (1)$$

where q(1) is the heat flux to heat flux detection container 1b from single heating surface 9, and −q(r,1) is the heat loss by heat flux detection container 1b or detector vial 1b through radiation emission.

The heat flux q to heat flux detection container 1a or sample container 1a, containing material 5 to be monitored by heat flux detection system 10 during a process such as a drying process, is defined as:

$$q=q(2)+q(r,2) \quad (2)$$

where q(2) is the heat flux to heat flux detection container 1a containing material 5 and q(r,2) is the additional heat flux to heat flux detection 1a by radiation absorption through the outer walls of detection container 1a.

The heat flux q(1) to reference heat flux detection container 1b is given as:

$$q(1)=\frac{AK(T(s)-T(v,1))}{d} \quad (3)$$

where q(2) is the cross-sectional area of reference heat flux detection container 1b, K is the thermal conductivity between heat flux detection containers 1a,b and single heating surface 9, T(s) is the temperature of single heating surface 9 supporting heat flux detection containers 1a,b, T(v,1) is the temperature indicated by thermocouple sensor 2 disposed upon reference heat flux detection container 1b corrected for the temperature of heat flux detection container 1a, and d is the distance between single heating surface 9 and thermocouple sensor 2 of reference heat flux detection container 1b.

The heat flux q(2) to sample heat flux detection container 1a is defined as:

$$q(2)=\frac{AK(T(s)-T(v,2))}{d} \quad (4)$$

where T(v,2) is the temperature indicated by thermocouple sensor 2 of sample heat flux detection container 1a containing material 5 within heat flux detection system 10.

The heat flux to sample container 1a containing material 5 that is associated with the drying process being monitored by heat flux detection system 10 is represented by the difference in the heat flux (D(q)) between heat flux detection containers 1a,b. This dif determined heat flux values D(q) is expresse $$D(q)=q-q(o)$$

where q(o) is the heat flux to heat flux dete tainer 1a in the absence of drying, or $$D(q)=\frac{AK[(T(v,1)-T(v,2)]}{d}+q(r,2)+q(r,$$

where q(v,2) and q(v,1) are the heat flux to walls of heat flux detection containers 1a, tively. Setting AK/d=C, expression (6) bec $$D(q)=C[(T(v,1)-T(v,2)].$$

The rate of drying within heat flux detection is defined as:

$$R=\frac{q}{\Delta H_{v,T}}=\frac{D(q)}{\Delta H_{v,T}}$$

where $\Delta H_{v,T}$ is the heat of vaporization at a te (T) of heating surface 9. The substitution of t sion for D(q) in Equation (6) into Equation ( $$R=\frac{C[(T(v,1)-T(v,2)]}{\Delta H_{v,T}}+\frac{q(r,2)+q(r,1)}{\Delta H_{v,T}}$$

As q(r,2) and q(r,1) can be determined or a proach a value of zero, then:

$$R=\frac{C[(T(v,1)-T(v,2)]}{\Delta H_{v,T}}.$$

Therefore, the drying rate of material 5, as d by heat flux detection system 10, approaches value of T(v,1) approaches the value of T(v, Thus, it will be understood by those skillec that the method of the present invention, as using heat flux detection system 10, determin flux to or from heat flux detection contai Using these determinations, a further deterr made of the differential heat flux between detection containers 1a,b. From these deter many additional parameters may be determir additional parameters may include, but are r to, the rate of drying of material 5.

For example, the freezing rate of material determined using heat flux detection system tionally, after the drying of material 5, a det may be made of the stability of dried mater stability determination may be made within detection system 10 by applying further therr to heat flux detection containers 1a,b and fu tainers 11 by way of single heating shelf 9 wit chamber 12 to cause dried material 5 to deg degrading of material 5 may be measured to the stability of material 5. Additionally, this tion of the stability of material 5 may be m single heating surface 9 and containers 1a,b, side drying chamber 12.

Heat flux detection system 10 of the presen provides information on the heat flux to mate processed during the time that processing of is taking place. Heat flux detection system 1 can adjust process parameters during the processing of material 5 in accordance with heat flux related parameters which may be measured or determined within heat flux detection system 10 during the heating process. For example, the rate of drying may be determined by heat flux detection system 10 thereby permitting computer system 6 of heat flux detection system 10 to control thermal energy control means 9 by way of control line 14 to maintain the determined rate of drying or to alter the rate of drying. Additionally, computer system 6 may apply signals to drying chamber 12 by way of control line 14 to control the pressure within drying chamber 12, the processing time of material 5 within heat flux detection system 10, or any other process variable within drying chamber 12 and heat flux detection system 10.

The differential nature of the temperature measurements performed by heat flux detection system 10 of the present invention causes the determination of process parameters such as the drying rate of material 5 to be independent of thermocouple sensors 2 used in the process being monitored. In this way, a difference or change in the output of thermocouple sensors 2 does not have an effect on the determination of a process parameter by heat flux detection system 10. Furthermore, it will be understood by those skilled in the art that other types of sensors 2 besides thermocouples may be used to monitor heat flux detection containers 1*a,b* of heat flux detection system 10. The requirement for operation of heat flux detection system 10 is that sensors 2 produce a signal representative of the temperature of heat flux detection containers 1*a,b*.

Additionally, other methods for determining the temperature of heat flux detection containers 1*a,b*, not requiring physical contact between the sensors and heat flux detection containers 1*a,b*, may be used within heat flux detection system 10 of the present invention. For example, the temperature and heat flux of heat flux detection containers 1*a,b* may be determined by measuring radiant thermal energy in the vicinity of heat flux detection containers 1*a,b* by non-contact radiant energy sensors 2 or non-contact radiant temperature sensors 2. Such non-contact radiant energy sensors 2 or non-contact temperature sensors 2 may be used whether the method of the present invention is performed within drying chamber 12 or outside of drying chamber 12. In this respect, the only requirement for operation of heat flux detection system 10 is that sensors 2 provide computer system 6 with signals representative of the temperature of heat flux detection containers 1*a,b* in the same manner as that described for contact type thermocouple sensors 2 and suitable for the determination of the heat flux of heat flux detection containers 1*a,b*.

Drying chamber 12 may be provided with several shelves for supporting a larger number of further containers 11 of material 5 for processing during a process, such as a drying process, being monitored by heat flux detection system 10. Since it is possible for material 5 within further containers 11 on different shelves of multishelf drying chamber 12 to dry at different rates, each shelf of multishelf drying chamber 12 may be provided with an independent heat flux detection system 10. Each independent heat flux detection system 10 includes an individual sample container 1*a* and reference container 1*b*. This use of independent heat flux detection systems 10 permits independent determinations of the drying rates on each of the shelves of multishelf drying chamber 12. Additionally, a plurality of heat flux detection systems 10 may be provided on a single shelf of drying chamber 12 to permit independent determinations of the drying rate to be made at different areas on the same shelf.

Calibration of heat flux detection system 10 requires two steps. The first step in calibrating heat flux detection system 10 is determining the temperature of reference heat flux detection container 1*b* with respect to sample heat flux detection container 1*a* when heat flux detection containers 1*a,b* are both empty. Under these conditions, the temperature (T(v,1)) represents the temperature of heat flux detection container 1*a* when empty before the sample of material 5 is placed in heat flux detection container 1*a*.

The second part of the calibration procedure of heat flux detection system 10 requires the determination of the value C with respect to heat flux detection container 1*a*. This is accomplished by adding a known mass of water to heat flux detection container 1*a*. The quantity of water added to should be sufficient to just cover thermocouple temperature sensor 2 at the bottom of heat flux detection container 1*a*. Both heat flux detection containers 1*a,b* are sealed and refrigerated to cool containers 1*a,b* to a low temperature, for example, approximately five degrees C.

After approximately two hours at this temperature, heat flux detection containers 1*a,b* are removed from refrigeration and placed on a metal surface in an isothermal chamber that is at a temperature between twenty degrees C and thirty degrees C. From a knowledge of the temperature relationship between heat flux detection containers 1*a,b* and the heat capacity of water for a given temperature, the constant C for heat flux detection container 1*a* is determined by a measure of change in enthalpy per unit time as a function of (T(v,1)–T(v,2)). This relationship between the difference in heat flux between heat flux detection containers 1*a,b* , expressed as (D(q)), the temperature difference of heat flux detection containers 1*a, b,* (T(v,1)–T(v,2)), and the constant, C=AK/d, of a container is set forth in Equation (7).

With a knowledge of the value of C, as well as the amount of water in material 5, heat flux detection system 10 of the present invention indicates the rate at which the sample of material 5 is drying from heat flux detection container 1*a*. Heat flux detection system 10 thus permits computer system 6 to graphically display the fraction of material 5 that is dried on monitor screen 7. From the rate of drying, it is also possible for computer system 6 of heat flux detection system 10 to compute the completion time for a particular drying phase or for the total drying process.

While this invention has been described with reference to specific, and particularly preferred embodiments thereof, it is not limited thereto and the appended claims are intended to be construed to encompass not only the specific forms and variants of the invention shown but to such other forms and variants as may be devised by those skilled in the art without departing from the true spirit and scope of this invention.

I claim:

1. A system for determining a process parameter of a material in a processing system having a plurality of process parameters and first and second heat flux detection containers, comprising:

a sample of said material disposed within said first heat flux detection container;

single thermal energy control means for controlling the level of thermal energy both of said first heat flux detection container and of said second heat flux detection container;

means for determining the heat flux to said first heat flux detection container and to said second heat flux detection container while said single thermal energy control means controls the level of thermal energy of said first and second heat flux detection containers including means for determining a temperature difference between said first and second heat flux detection containers; and, means for determining said process parameter in accordance with said determined heat flux.

2. The system for determining a process parameter of a material of claim 1, wherein said single thermal energy control means comprises a single warming means for simultaneously applying thermal energy both to said first heat flux detection container and to said second heat flux detection container.

3. The system for determining a process parameter of a material of claim 1, wherein said single thermal energy control means comprises a single heating surface for disposing both said first heat flux detection container and said second heat flux detection container on said single heating surface.

4. The system for determining a process parameter of a material of claim 2, wherein said means for determining said heat flux comprises means for determining said heat flux of said first and second heat flux detection containers while said single warming means is simultaneously applied both to said first heat flux detection container and to said second heat flux detection container.

5. The system for determining a process parameter of a material of claim 1, wherein said single thermal energy control means comprises single cooling means for cooling both said first heat flux detection container and said second heat flux detection container.

6. The system for determining a process parameter of a material of claim 1, wherein said single thermal energy control means comprises a single refrigeration means for cooling both said first heat flux detection container and said second heat flux detection container.

7. The system for determining a process parameter of a material of claim 1, wherein said second heat flux detection container is provided with insulating means for limiting radiant heat transfer through the outside walls of said second heat flux detection container.

8. The system for determining a process parameter of a material of claim 7, wherein said insulating means is provided with a reflective surface.

9. The system for determining a process parameter of a material of claim 8, wherein said insulating means is formed of metal foil.

10. The system for determining a process parameter of a material of claim 1, wherein said process parameter is the drying rate of said material.

11. The system for determining a process parameter of a material of claim 1, wherein said means for determining said temperature difference comprises means thermocouple sensors disposed upon said first and second heat flux detection containers.

12. The system for determining a process parameter of a material of claim 1, wherein said first and second heat flux detection containers have substantially similar thermal properties.

13. The system for determining a process of a material of claim 1, wherein said first a heat flux detection containers are provided wi tive container sensors.

14. The system for determining a process of a material of claim 13, wherein said respe tainer sensors are thermocouples for sensing th ature of said first and second heat flux dete tainers.

15. The system for determining a process of a material of claim 1, wherein said processi is provided with at least one further heat flux container for applying said single thermal en trol means to said further heat flux detection

16. The system for determining a process of a material of claim 15, wherein further r disposed within said further heat flux dete tainer.

17. The system for determining a process of a material of claim 16, wherein said proce ter determining means comprises means for de said process parameter of said further mater said further heat flux detection container in a with the determined heat flux of said first a heat flux detection containers.

18. The system for determining a process of a material of claim 1, comprising the furthe means for providing a plurality of values termined process parameter including means for calculating a drying rate; and display means for displaying said plurality

19. The system for determining a process of a material of claim 18, wherein said disp comprises means for displaying the percent remaining in said material.

20. The system for determining a process of a material of claim 18, wherein said disp comprises means for displaying the rate of said material.

21. The system for determining a process of a material of claim 1, further comprising chamber for disposing said first and second detection containers within said drying cham

22. The system for determining a process of a material of claim 21, further comprising evacuating said drying chamber.

23. The system for determining a process of a material of claim 1, wherein said second detection container is empty.

24. An apparatus for determining a process of a material in a processing system for proc material, comprising:

first and second sensor containers, each s tainer being formed of container means means for providing sensor output signal tative of the temperature of said first a sensor containers;

a predetermined amount of said materia within said first sensor container;

thermal energy control means for contr temperature of said first and second sens ers;

means for receiving and storing said sen signals;

means for determining the rate of drying of rial in accordance with said stored sen signals; and, display means for providing a graphic display representative of said rate of drying of said material.

25. The apparatus for determining a process parameter of a material of claim 24, wherein said thermal energy control means comprises single thermal energy control means for controlling the thermal energy both to said first sensor container and to said second sensor container.

26. A system for determining a process parameter of a material in a processing system having first and second heat flux detection containers, comprising:

a sample of said material disposed within said first heat flux detection container;

thermal energy control means for controlling the level of thermal energy of said first and second heat flux detection containers;

means for determining the heat flux to said first heat flux detection container and to said second heat flux detection container including means for determining a temperature difference between said first and second heat flux detection containers; and, means for determining the rate of drying of said material in accordance with said determined heat flux while said single thermal energy control means controls the level of thermal energy of said first and second heat flux detection containers.

27. The system for determining a process parameter of a material of claim 26, wherein said thermal energy control means comprises single warming means for simultaneously applying thermal energy both to said first heat flux detection container and to said second heat flux detection container.

28. The system for determining a process parameter of a material of claim 26, wherein said single thermal energy control means comprises a single heating surface for disposing both said first heat flux detection container and said second heat flux detection container upon said single heating surface.

29. The system for determining a process parameter of a material of claim 27, wherein said means for determining said heat flux comprises means for determining said heat flux of said first and second heat flux detection containers while said single warming means is simultaneously applied both to said first heat flux detection container and to said second heat flux detection container.

30. The system for determining a process parameter of a material of claim 26, wherein said thermal energy control means comprises single cooling means for cooling both said first heat flux detection container and said second heat flux detection container.

31. The system for determining a process parameter of a material of claim 26, wherein said thermal energy control means comprises single refrigeration means for cooling both said first heat flux detection container and said second heat flux detection container.

32. The system for determining a process parameter of a material of claim 26, wherein said second heat flux detection container is provided with insulating means for limiting radiant heat transfer through the outside walls of said second heat flux detection container.

33. The system for determining a process parameter of a material of claim 32, wherein said insulating means is provided with a reflective surface.

34. The system for determining a process parameter of a material of claim 32, wherein said insulating means is formed of metal foil.

35. The system for determining a process parameter of a material of claim 26, wherein said means for determining said temperature difference comprises thermocouple sensors disposed upon said first and second heat flux detection containers.

36. The system for determining a process parameter of a material of claim 26, wherein said first and second heat flux detection containers have substantially similar thermal properties.

37. The system for determining a process parameter of a material of claim 26, wherein said first and second heat flux detection containers are provided with respective container sensors.

38. The system for determining a process parameter of a material of claim 37, wherein said respective container sensors are thermocouples for sensing the temperature of said first and second heat flux detection containers.

39. The system for determining a process parameter of a material of claim 26, wherein said processing system is provided with at least one further heat flux detection container for applying said thermal energy control means to said further heat flux detection container.

40. The system for determining a process parameter of a material of claim 39, wherein further material is disposed within said further heat flux detection container.

41. The system for determining a process parameter of a material of claim 40, wherein said process parameter determining means comprises means for determining said process parameter of said further material within said further heat flux detection container in accordance with the determined heat flux of said first and second heat flux detection containers.

42. The system for determining a process parameter of a material of claim 26, comprising the further steps of:

means for providing a plurality of values of said rate of drying of said material; and, display means for displaying said plurality of values.

43. The system for determining a process parameter of a material of claim 42, wherein said display means comprises means for displaying the percent of water remaining in said material.

44. The system for determining a process parameter of a material of claim 42, wherein said display means comprises means for displaying the rate of drying of said material.

45. The system for determining a process parameter of a material of claim 26, further comprising a drying chamber for disposing said first and second heat flux detection containers within said drying chamber.

46. The system for determining a process parameter of a material of claim 45, further comprising means for evacuating said drying chamber.

47. The system for determining a process parameter of a material of claim 26, wherein said second heat flux detection container is empty.

48. The system for determining a process parameter of a material of claim 26, wherein said system comprises a plurality of further process parameters and means for adjusting at least one further process parameter of said plurality of further process parameters in accordance with said determined rate of drying.

49. The system for determining a process parameter of a material of claim 48, comprising means for adjusting said rate of drying in accordance with said determined rate of drying.

50. The system for determining a process parameter of a material of claim 48, further comprising means for adjusting said thermal energy control means in accordance with said determined rate of drying.

51. A system for determining a process parameter of a material in a processing system having a plurality of process parameters and first and second heat flux detection containers, comprising:

a sample of said material disposed within said first heat flux detection container and said second container being empty;

single thermal energy control means for co the level of thermal energy both of said flux detection container and of said heat fl tion container;

means for determining the heat flux to said flux detection container and to said sec flux detection container while said single energy control means controls the level o energy of said first and second heat flux containers; and, means for determining said process parame cordance with said determined heat flux.

* * * * *

US005367787A

United States Patent [19]

Ikeda et al.

[11] Patent Number: 5,3(

[45] Date of Patent: Nov. 2(

[54] DRYING MACHINE

[75] Inventors: Tomohiko Ikeda, Kusatsu; Toshiaki Sakamoto, Shiga, both of Japan

[73] Assignee: Sanyo Electric Co., Ltd., Osaka, Japan

[21] Appl. No.: 102,307

[22] Filed: Aug. 5, 1993

[30] Foreign Application Priority Data

Aug. 5, 1992 [JP] Japan ..... 4-209143

[51] Int. Cl.[5] ..... F26B 19/00

[52] U.S. Cl. ..... 34/549; 34/494; 34/77; 34/477

[58] Field of Search ..... 34/467, 468, 493, 494, 34/497, 499, 549, 73, 77, 78, 595, 604, 607–610, 475, 476, 477, 544, 554

[56] References Cited

U.S. PATENT DOCUMENTS 4,206,552 6/1980 Pomerantz et al. ..... 34/48 X

FOREIGN PATENT DOCUMENTS 50-2294 1/1985 Japan .

38797 2/1991 Japan .

*Primary Examiner*—Denise L. Gromada

[57] ABSTRACT

A drying machine has a drying chamber for c article cleaned with an inflammable solvent a: gent. A hot air supply channel communicates drying chamber and a heater is mounted in th supply channel. A hot air evacuation channel c cates with the drying chamber and a hot air device is mounted at a voluntary portion of th supply channel and the hot air evacuation ch control device is provided for driving contr heater. A first temperature sensor is mounte downstream side of the heater in the hot a channel and a second temperature sensor is m a position shifted to the drying chamber in th evacuation channel. The control device con heater so that the difference in the temperature by the first temperature sensor and the ten detected by the second temperature sensor within a safe temperature range.

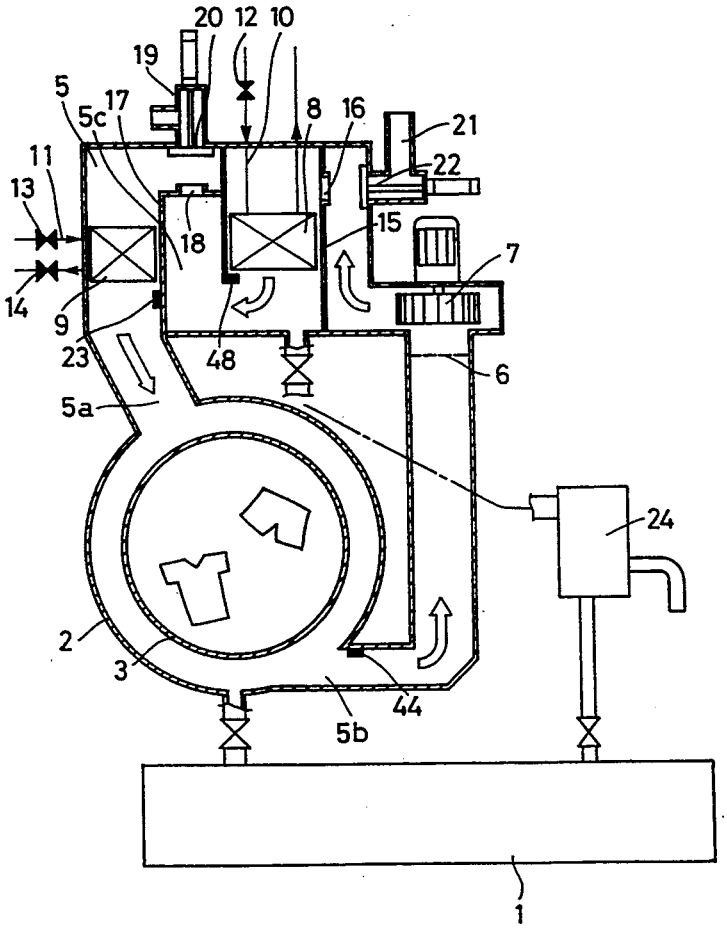

14 Claims, 7 Drawing Sheets